US009585194B2

(12) United States Patent
Fernández Llona

(10) Patent No.: US 9,585,194 B2
(45) Date of Patent: Feb. 28, 2017

(54) SYSTEM FOR DETERMINING THE NOMINAL VOLTAGE OF A POWER SUPPLY

(75) Inventor: Gonzalo Fernández Llona, Mondragón (ES)

(73) Assignee: COPRECITEC, S.L., Aretxabaleta (ES)

( * ) Notice: Subject to any disclaimer, the term of this patent is extended or adjusted under 35 U.S.C. 154(b) by 2211 days.

(21) Appl. No.: 12/187,313

(22) Filed: Aug. 6, 2008

(65) Prior Publication Data

US 2009/0039072 A1 Feb. 12, 2009

(30) Foreign Application Priority Data

Aug. 6, 2007 (ES) ..... 200702210

(51) Int. Cl.
*H05B 1/02* (2006.01)

(52) U.S. Cl.
CPC ..... *H05B 1/0266* (2013.01)

(58) Field of Classification Search
CPC .. A61K 31/423; A61K 31/538; A61K 31/428; A61K 36/88; C07D 263/58; C07D 265/36; H05B 1/0266
USPC ..... 219/497, 499, 505, 506, 410, 412, 413, 219/414, 483, 484, 485, 501, 486; 323/235, 319, 236; 307/117, 130, 310; 361/76, 79, 88, 91, 6, 85, 86; 363/44–48
See application file for complete search history.

(56) References Cited

U.S. PATENT DOCUMENTS 3,404,289 A * 10/1968 Broderick ..... 327/58
3,665,212 A * 5/1972 Roberts et al. ..... 327/451
3,702,435 A * 11/1972 Endo et al. ..... 323/236
3,946,252 A * 3/1976 Juodikis ..... 327/458
4,051,394 A * 9/1977 Tieden ..... 327/79
4,598,195 A * 7/1986 Matsuo ..... 219/497
4,623,041 A * 11/1986 Horbrugger et al. ..... 187/392
4,745,515 A * 5/1988 Fowler ..... 361/185
5,101,575 A * 4/1992 Bashark ..... 34/562
5,640,113 A * 6/1997 Hu ..... 327/162
5,726,561 A * 3/1998 Ghosh et al. ..... 323/255
5,804,991 A * 9/1998 Hu ..... 327/162
5,883,796 A * 3/1999 Cheng et al. ..... 363/40
6,271,506 B1 * 8/2001 Glaser ..... 219/505
6,841,761 B1 * 1/2005 Banzato et al. ..... 219/486
6,969,927 B1 * 11/2005 Lee ..... 307/32
(Continued)

FOREIGN PATENT DOCUMENTS

GB 1390345 A * 4/1975

*Primary Examiner* — David Angwin
*Assistant Examiner* — Frederick Calvetti
(74) *Attorney, Agent, or Firm* — Edell, Shapiro & Finnan LLC

(57) ABSTRACT

A system and method for controlling the output power of a heat source. The system includes a user interface so that a user may select the power required from the heat source, a power supply, and a controller that receives a rectified signal having a work ratio that corresponds to a nominal voltage of an alternating voltage signal corresponding to a phase of a power supply. The controller is configured to control the output power of the heat source in accordance with the power selected by the user, and modifies, if necessary, the work cycle of a power signal linked to the heat source in accordance with the work ratio in order to compensate possible differences in the nominal voltage between different power supplier.

9 Claims, 5 Drawing Sheets

(56) References Cited

U.S. PATENT DOCUMENTS

| | | | | |
|---|---|---|---|---|
| 7,098,555 | B2 * | 8/2006 | Glahn et al. | 307/32 |
| 7,170,194 | B2 * | 1/2007 | Korcharz et al. | 307/21 |
| 7,355,374 | B2 * | 4/2008 | Witte et al. | 323/282 |
| 7,508,240 | B1 * | 3/2009 | Yurick et al. | 327/79 |
| 8,063,588 | B1 * | 11/2011 | Ribarich et al. | 315/360 |
| 8,102,080 | B2 * | 1/2012 | Fonseca et al. | 307/130 |
| 2004/0105283 | A1 * | 6/2004 | Schie et al. | 363/21.12 |
| 2005/0243581 | A1 * | 11/2005 | Witte et al. | 363/16 |
| 2009/0167085 | A1 * | 7/2009 | Fonseca et al. | 307/32 |
| 2009/0294434 | A1 * | 12/2009 | Fonseca et al. | 219/498 |

* cited by examiner

SYSTEM FOR DETERMINING THE NOMINAL VOLTAGE OF A POWER SUPPLY

CROSS-REFERENCE TO RELATED APPLICATIONS

This application claims priority to Spanish Patent Application ES-P200702210, filed Aug. 6, 2007.

TECHNICAL FIELD

The present invention relates to systems for determining the nominal voltage of a power supply, and more specifically to systems for determining the nominal voltage of the power supply of domestic appliances, particularly heat sources, so that the control of power linked to a heat source may be adjusted in accordance with the nominal voltage that is determined.

BACKGROUND

The most widely used method for controlling the temperature of a heat source (linked to a specific power) is to use a closed-loop control in which the temperature of a heat source or its surroundings is determined by a temperature sensor, and in which an automatic control is used to adjust the power of the heat source for the purposes of reaching and maintaining the required temperature. A thermostat may be used for this purpose, for example. Although the closed-loop temperature control is effective, it is not easy to use in some applications, such as cooker hob heat sources.

In devices in which heat sources supplied by external power supplies are used it is desirable that the nominal voltage of the power supply be ascertained, as the heat emitted by the heat sources is directly related to the nominal voltage. Different nominal voltages may thus result in different temperatures in the heat source despite the fact that the required or selected power is the same in all cases.

In the United States, for example, it is known that domestic appliances may be connected to an external 208V three-phase power supply with a phase difference of 120° between two adjacent phases or to a 240V two-phase power supply with a phase difference of 180° between both phases. When a specific power is selected for a determined heat source, the heat emitted by the source may be different if the external supply is 208V or if it is 240V, and it may thus be the case, for example, that food may have to be cooked in a different way in both of these cases.

In order to solve this problem, U.S. Pat. No. 6,841,761 B1 discloses a system for identifying the nominal voltage of the voltage supply to which at least one heat source is connected, which takes into account the phase difference between the various phases of the power supply. The system disclosed in the patent detects the phase difference between two adjacent phases, determining the value of the nominal voltage in accordance with the phase difference detected (if it is 180° the nominal voltage is 240V, and if it is not, it is 208V).

SUMMARY OF THE DISCLOSURE

It is the object of the invention to provide a control system and system for determining the nominal voltage as described in the claims.

The system of the invention is used to determine the nominal voltage of an external multi-phase power supply, and thereby control at least one heat source connected to the power supply, the power being appropriately regulated regardless of the value of the nominal voltage. The heat source may be the source of a cooker hob, for example, the system comprising a user interface so that a user may select the power (and therefore the temperature) required in the heat source.

The system of the invention comprises a rectifier/rectification means for rectifying the alternating voltage signal of each phase of the power supply, a rectified signal thereby being obtained for each phase, along with a controller/control means that may receive the rectified signal and which may determine the work ratio of the rectified signal, and a modifier/modification means for ensuring that the work ratio of the rectified signal depends on the nominal voltage of the alternating voltage signal of the corresponding phase.

The controller/control means may control the output power of the heat source in accordance with the power required by the user, the work cycle of a power signal linked to the heat source thereby being modified in accordance with the work ratio determined by the controller/control means, in order to compensate possible differences in the nominal voltage between different power supplies.

In this way, depending on the work ratio of the rectified signal, the value of the nominal voltage of the power supply may be identified, allowing the work cycle of the power signal of the corresponding heat source to be set (compensated) so that it always responds with the same power for the power required by the user, the corresponding heat source thus being able to emit the same temperature for the same selected power, regardless of the value of the nominal voltage of the power supply.

In accordance with one aspect of the present invention a system for controlling at least one heat source connected to an alternating voltage power supply is provided that comprises a user interface that permits a user to select an output power of the heat source, a rectifier that produces at least one square and periodic rectified signal corresponding to at least one phase of the alternating voltage produced by the power supply, a controller that is configured to receive the rectified signal and which determines the work ratio of said rectified signal, and a modifier disposed in series between the power supply and the rectifier that acts upon the at least one phase of the alternating voltage in a manner that causes the work ratio of the rectified signal produced by the rectifier to be dependent on a nominal voltage of the alternating voltage, the controller being capable of controlling the output power of the heat source in accordance with the power selected by the user, and modifying, if necessary, the work cycle of a power signal linked to the heat source in accordance with the determined work ratio in order to compensate possible differences in the nominal voltage between different power supplies.

In accordance with another aspect of the present invention a method of controlling the output power of a heat source is provided, the method comprising rectifying at least one phase of the alternating voltage to produce at least one square and periodic rectified signal, determining the work ratio of the rectified signal, prior to rectifying the at least one phase of the alternating voltage, acting upon the at least one phase of the alternating voltage in a manner that causes the work ratio of the rectified signal produced by the rectifier to be dependent on a nominal voltage of the alternating voltage, and controlling the output power of the heat source in accordance with a power selected by the user via a user interface, and modifying, if necessary, the work cycle of a power signal linked to the heat source in accordance with the determined work ratio in order to compensate possible differences in the nominal voltage between different power supplies.

These and other advantages and characteristics of the invention will be made evident in the light of the drawings and the detailed description thereof.

DETAILED DESCRIPTION

Figure 1:
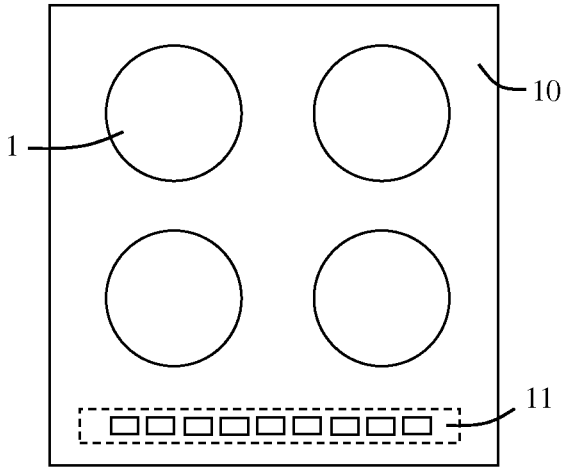
FIG. 1 is a ground view of a cooker hob in an embodiment of the present invention.

According to an aspect of the present invention, a system is provided to determine the nominal voltage of an external multi-phase power supply 2, and thereby control the power supplied to at least one heat source 1 connected to the power supply 2, and therefore to control the output temperature of the heat source 1, it being appropriately regulated regardless of the value of the nominal voltage. With reference to FIG. 1, the heat source 1 may be a part of a cooker hob 10 for example, the system comprising a user interface 11 so that a user may select the power required in the heat source 1. The system also comprises a controller/control means 5 that modify the work cycle of a square power signal corresponding to the heat source 1 in accordance with the power required by the user, thus increasing the width of the positive pulse of the power signal if more power is required, or decreasing it if the reverse is required.

Figure 2:
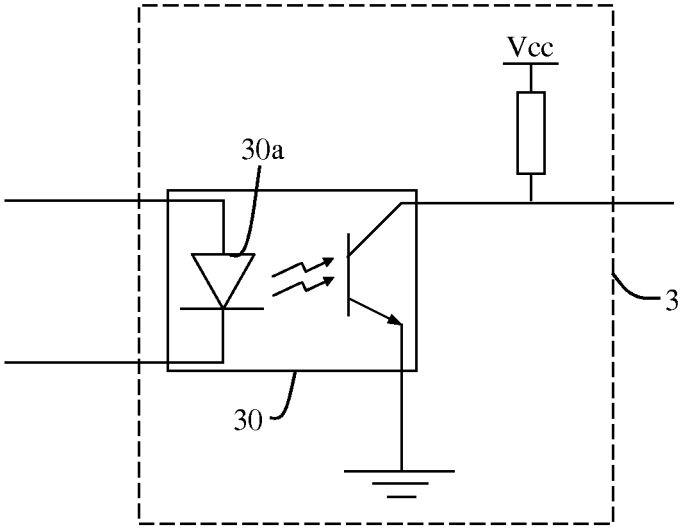
FIG. 2 is a schematic view of a rectifier/rectification means in an embodiment of the present invention.
Figure 4:
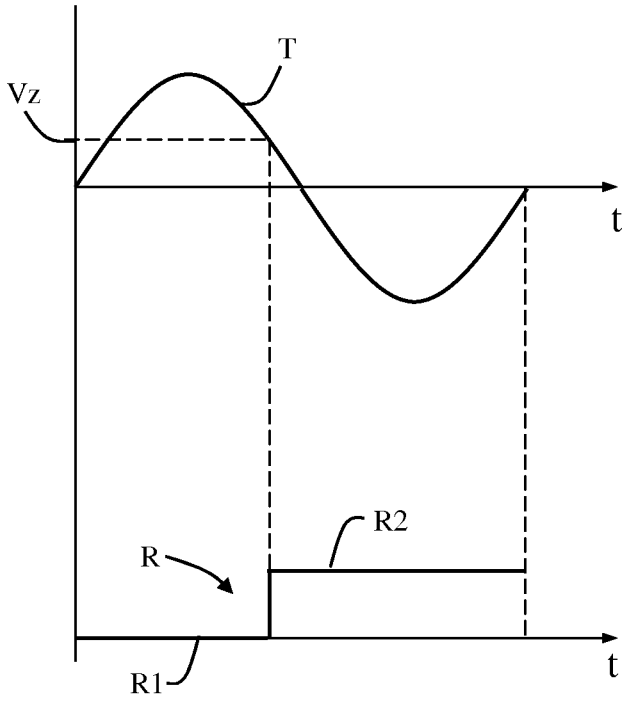
FIG. 4 is a graphic representation of a rectified signal of an alternating voltage signal of a phase in an embodiment of the present invention.

The power supply 2 is an alternating voltage supply that therefore generates an alternating voltage signal T for each phase, the system comprising a rectifier/rectification means 3, as shown in FIG. 2, for each phase which rectifies the alternating voltage signals T, thus creating a square and periodic rectified signal R with the same period as the corresponding alternating voltage signal T for each phase, as shown in FIG. 4. In an embodiment, the rectifier/rectification means 3 comprises an optocoupler 30, as shown in FIG. 2, that ensures that the area of continuous voltage (rectified signal R) is isolated from the area of alternating voltage (alternating voltage signal T). The optocoupler 30 comprises a diode 30*a* which ensures that it only allows the current to pass through it in the positive semi-cycles of the alternating voltage signal T, thus causing the rectified signal R to have a void value (void interval R1).

The controller/control means may receive the rectified signal R and may determine the work ratio of the rectified signal R (the relationship between the void interval R1 and a positive pulse R2 of the square rectified signal R). The modifier/modification means 4 in at least one of the phases of the power supply 2 ensures that the work ratio of the rectified signal R corresponding to the phase depends on the nominal voltage of the alternating voltage signal T of the corresponding phase. As a result, the controller/control means may determine the nominal voltage of the power supply 2 in accordance with the determined ratio, the output power of the heat source 1 thus being capable of being controlled in accordance with the power required by the user and in accordance with the work ratio of the determined rectified signal R, thereby modifying the work cycle of the power signal linked to the heat source 1. Thus, the controller/control means may determine the nominal voltage of the power supply 2 and compensate for possible differences between different power supplies 2, which may have nominal values of 208V or 240V, a single temperature thus being obtained for a given power in the heat source 1 regardless of the value of the nominal voltage of the power supply 2.

Figure 3:
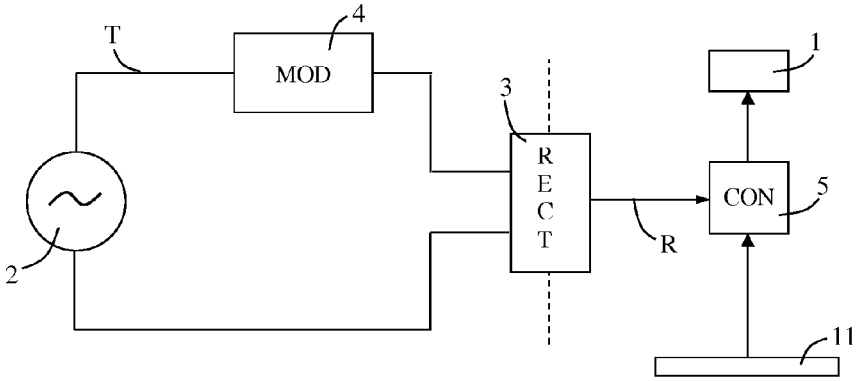
FIG. 3 is a schematic view of a circuit in an embodiment of the present invention.
Figure 5:
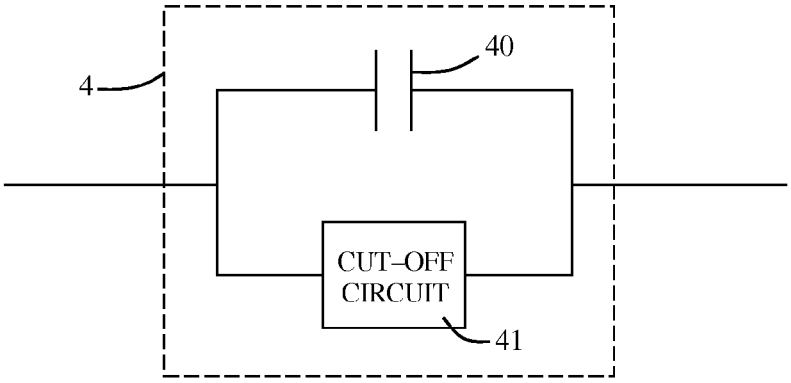
FIG. 5 is a schematic representation of a modifier/modification means in an embodiment of the present invention.
Figure 6:
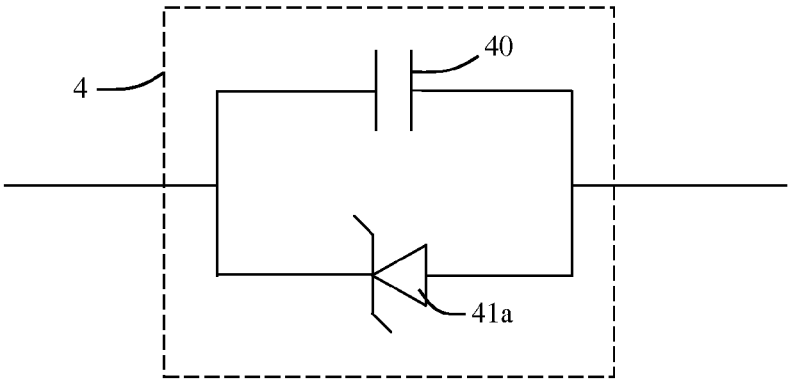
FIG. 6 is a schematic representation of a cut-off element/circuit in an embodiment of the present invention.

With reference to FIGS. 5 and 6, in one embodiment the modifier/modification means 4 of a phase comprises cut-off element/circuit 41 that ensures that the void interval R1 of the rectified signal R ends when the nominal voltage of the power supply 2 drops from a specific value, and start element/circuit that cause the void interval R1 to commence approximately at the moment the alternating voltage signal T of the phase passes through zero, from a negative to a positive value. The modifier/modification means 4 is disposed in series between the power supply 2 and the rectifier/rectification means 3 of the corresponding phase as shown in FIG. 3, the start element/circuit comprising in one embodiment a capacitor 40 that is disposed in parallel to the cut-off element/circuit 41, the capacitor 40 allowing a current originating from the power supply 2 of the phase to reach the corresponding rectification means 3 from the moment in which the alternating voltage signal T of the power supply 2 passes through zero from a negative to a positive value. At the beginning of each cycle, when the alternating voltage signal T comprises a void value, the capacitor 40 is not charged. As the value of the alternating voltage signal T increases, the capacitor 40 begins to be charged allowing the passage of a current to the rectifying means, which passes through the diode 30*a* of the optocoupler 30.

In one embodiment, the cut-off element/circuit 41 comprise at least one Zener diode 41*a* that causes the void interval R1 of the rectified signal R to end when the alternating voltage signal T of the power supply 2 drops from a value determined by the Zener diode 41*a* itself, thereby preventing the passage of current originating from the power supply 2 to the corresponding rectification means 3. When the alternating voltage signal T reaches a voltage value Vz determined by the Zener diode 41*a* and, therefore, when the capacitor 40 has been charged up to the value Vz, the current that reaches the rectifier/rectification means 3 passes through the Zener diode 41*a* instead of the capacitor 40. When the alternating voltage signal T drops once more to the value determined by the Zener diode 41*a*, the current stops passing through the Zener diode 41*a* and the capacitor 40 begins to discharge with an inverse current, thereby stopping the current from passing through the diode 30*a* of the optocoupler 30, thus ending the void interval R1 of the rectified signal R. As a consequence, the smaller the value of the nominal voltage of the alternating voltage signal T, the sooner the current will stop passing through the diode 30*a*, thereby reducing the duration of the void interval R1 and increasing the work ratio (the ratio between the duration of the positive pulse and the void value pulse), the nominal voltage of the alternating voltage signal T being capable of being determined in accordance with the work ratio.

Figure 7:
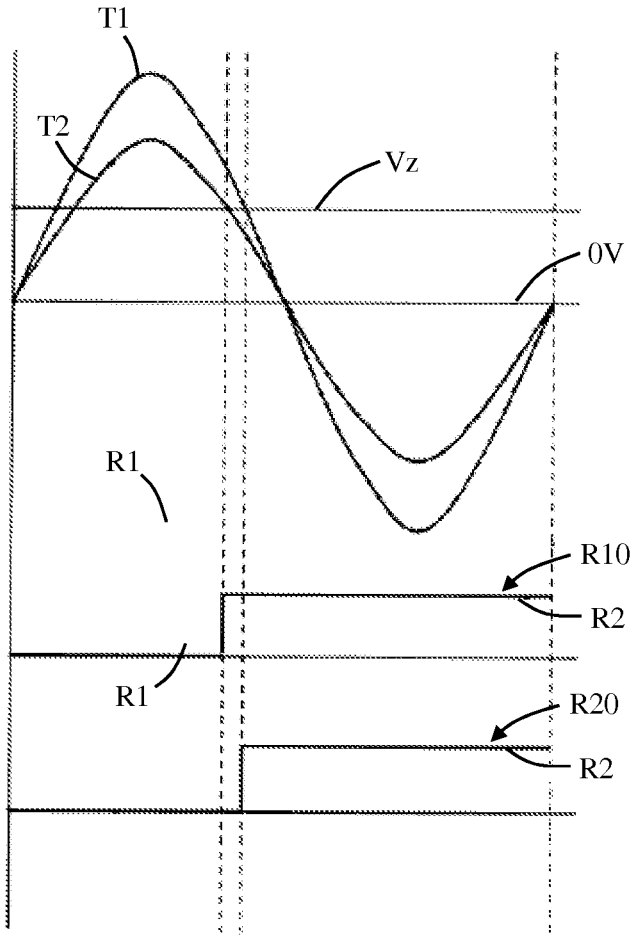
FIG. 7 illustrates the rectified signals produced by a modifier and a rectifier for two different alternating voltages in accordance with the teachings of the present invention.

FIG. 7 illustrates a phase of an alternating voltage for two different nominal voltages T1 and T2 and the resultant rectified signals R10 and R20. Vz represents the Zener diode voltage. As shown, as a result of the modifier/modification means 4, the rectified signals T1 and T2 have different R1 and R2 values and, hence, different work ratios. As previously discussed, the controller 5 is able to calculate the work ratio of the rectified signal based on the R1 and R2 values, and as a result, can identify the nominal voltage of the power supply 2.

While the above description contains a number of specifics, those specifics should not be construed as limitations on the scope of the disclosure, but merely as exemplifications of preferred embodiments thereof. Those skilled in the art will envision many other possible variations that are within the scope and spirit of the disclosure.

What is claimed is:

1. A system for controlling at least one heat source connected to an alternating voltage power supply, the system comprising:

a user interface that permits a user to select an output power of the heat source, a rectifier that produces at least one square and periodic rectified signal corresponding to at least one phase of the alternating voltage produced by the power supply, a controller that is configured to receive the rectified signal and which determines the work ratio of said rectified signal, the work ratio being the ratio between the duration of a positive pulse and the duration of a void interval of the rectified signal, and a modifier disposed in series between the power supply and the rectifier that acts upon the at least one phase of the alternating voltage in a manner that causes the work ratio of the rectified signal produced by the rectifier to be dependent on a nominal voltage of the alternating voltage, the controller being capable of controlling the output power of the heat source in accordance with the power selected by the user, and modifying the work cycle of a power signal linked to the heat source in accordance with the determined work ratio in order to compensate possible differences in the nominal voltage between different power supplies.

2. A system according to claim 1, wherein the rectified signal comprises a void interval and a positive pulse in each period, the modifier comprising a cut-off element that causes the void interval of the rectified signal to end when the nominal voltage of the power supply drops from a specific value.

3. A system according to claim 2, wherein the cut-off element comprises at least one Zener diode that causes the void interval of the rectified signal to end when the nominal voltage of the power supply drops from a value determined by the Zener diode, thereby preventing the passage of current originating from the power supply to the corresponding rectifier.

4. A system according to claim 2, wherein the modifier comprises a start element that cause the void interval of the rectified signal to commence approximately at the moment the alternating voltage signal of said phase passes through zero, from a negative to a positive value.

5. A system according to claim 3, wherein the modifier comprises a start element that cause the void interval of the rectified signal to commence approximately at the moment the alternating voltage signal of said phase passes through zero, from a negative to a positive value.

6. A system according to claim 4 wherein the start element comprises a capacitor that is disposed in parallel to the cut-off element, the capacitor allowing a phase of current originating from the power supply to reach a corresponding rectifier from the moment in which the alternating voltage signal of said power supply passes through zero, from a negative to a positive value.

7. A system according to claim 5 wherein the start element comprises a capacitor that is disposed in parallel to the cut-off element, the capacitor allowing a phase of current originating from the power supply to reach a corresponding rectifier from the moment in which the alternating voltage signal of said power supply passes through zero, from a negative to a positive value.

8. A system according to claim 1 wherein the alternating voltage of the power supply comprises a three phase alternating voltage, the system comprising a modifier and a rectifier for each of said phases.

9. A method of controlling the output power of a heat source, the method comprising:

rectifying at least one phase of the alternating voltage to produce at least one square and periodic rectified signal, determining the work ratio of the rectified signal, the work ratio being the ratio between the duration of a positive pulse and the duration of a void interval of the rectified signal, prior to rectifying the at least one phase of the alternating voltage, acting upon the at least one phase of the alternating voltage in a manner that causes the work ratio of the rectified signal produced by the rectifier to be dependent on a nominal voltage of the alternating voltage, and controlling the output power of the heat source in accordance with a power selected by the user via a user interface, and modifying the work cycle of a power signal linked to the heat source in accordance with the determined work ratio in order to compensate possible differences in the nominal voltage between different power supplies.

* * * * *